US011173732B2

(12) United States Patent
Suzuki et al.

(10) Patent No.: US 11,173,732 B2
(45) Date of Patent: Nov. 16, 2021

(54) PRINTING APPARATUS AND CONVEYANCE APPARATUS

(71) Applicant: CANON KABUSHIKI KAISHA, Tokyo (JP)

(72) Inventors: Yoshiaki Suzuki, Nagareyama (JP); Ryo Kobayashi, Fuchu (JP); Tsutomu Obata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 84 days.

(21) Appl. No.: 16/831,888

(22) Filed: Mar. 27, 2020

(65) Prior Publication Data

US 2020/0307272 A1 Oct. 1, 2020

(30) Foreign Application Priority Data

Mar. 29, 2019 (JP) ..... JP2019-065975

(51) Int. Cl.

| | |
|---|---|
| ***B41J 11/70*** | (2006.01) |
| ***B41J 11/68*** | (2006.01) |
| ***B41J 11/66*** | (2006.01) |
| *B26D 11/00* | (2006.01) |

(52) U.S. Cl.

CPC ..... *B41J 11/70* (2013.01); *B41J 11/66* (2013.01); *B41J 11/68* (2013.01); *B26D 11/00* (2013.01); *B41J 11/706* (2013.01)

(58) Field of Classification Search

CPC ... B41J 11/70; B41J 11/66; B41J 11/68; B41J 11/706; B26D 11/00

See application file for complete search history.

(56) References Cited

U.S. PATENT DOCUMENTS

| | | | | |
|---|---|---|---|---|
| 5,459,580 | A | 10/1995 | Suzuki | |
| 7,104,216 | B2 | 9/2006 | Suzuki et al. | |
| 7,192,112 | B2 | 3/2007 | Nakanishi et al. | |
| 7,192,114 | B2 | 3/2007 | Suzuki et al. | |
| 7,690,744 | B2 | 4/2010 | Nakanishi et al. | |
| 7,901,022 | B2 | 3/2011 | Nakanishi et al. | |
| 8,419,155 | B2 | 4/2013 | Kawakami et al. | |
| 8,727,526 | B2 | 5/2014 | Yamamoto et al. | |
| 8,783,851 | B2 | 7/2014 | Suzuki et al. | |
| 2004/0037960 | A1 | 2/2004 | Suzuki et al. | |
| 2005/0024464 | A1* | 2/2005 | Takagi | B41J 11/70 347/104 |

(Continued)

FOREIGN PATENT DOCUMENTS

JP 2017-013438 A 1/2017

*Primary Examiner* — Henok D Legesse

(74) *Attorney, Agent, or Firm* — Venable LLP

(57) ABSTRACT

To provide a printing apparatus and a conveyance apparatus that are capable of preventing a cut position to be cut by a slitter (cutting unit) from deviating, a printing apparatus, which is configured to perform printing by use of a printing unit on a printing medium conveyed by a conveyance unit and is configured to cut the printing medium on which the printing has been performed by the printing unit by use of a cutting unit at a cut position along a conveyance direction of the conveyance unit, includes an abutment portion configured to abut on a printing surface of the printing medium at an inner position relative to the cut position in a width direction of the printing medium, the width direction that crosses the conveyance direction.

16 Claims, 8 Drawing Sheets

(56) References Cited

U.S. PATENT DOCUMENTS

| | | | | |
|---|---|---|---|---|
| 2013/0101330 | A1* | 4/2013 | Yoshida | B26D 7/1863<br>400/621 |
| 2013/0208043 | A1 | 8/2013 | Kawakami et al. | |
| 2013/0271544 | A1* | 10/2013 | Yajima | B26D 7/00<br>347/104 |
| 2013/0271545 | A1* | 10/2013 | Nagashima | B41J 11/663<br>347/104 |
| 2015/0246564 | A1* | 9/2015 | Toriihara | B26D 7/18<br>347/104 |

* cited by examiner

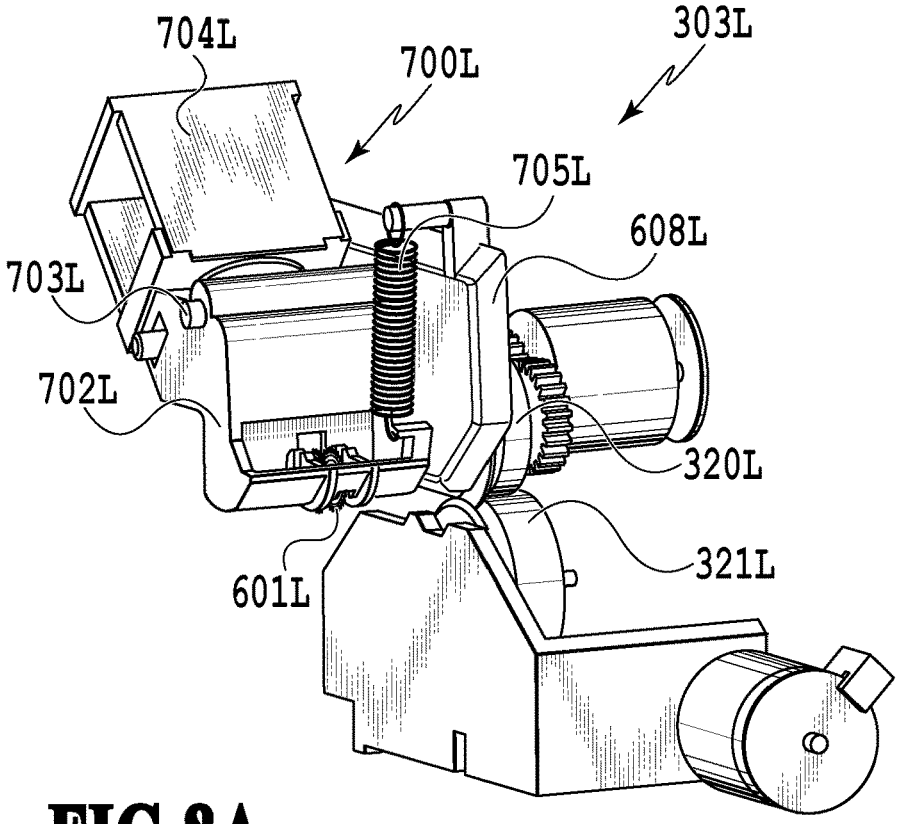
FIG.8A
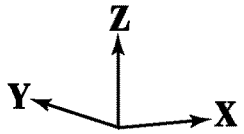
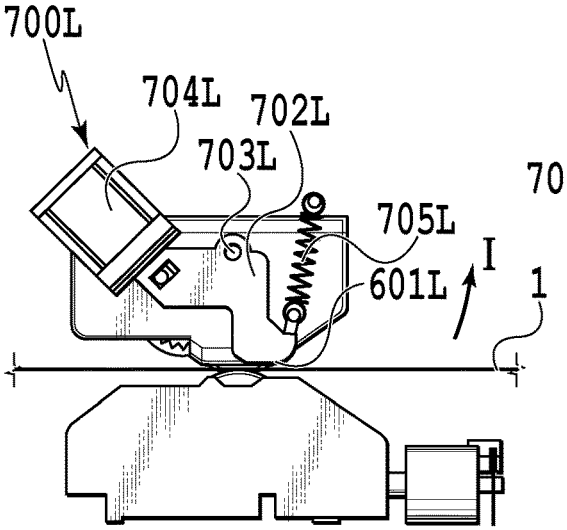
FIG.8B
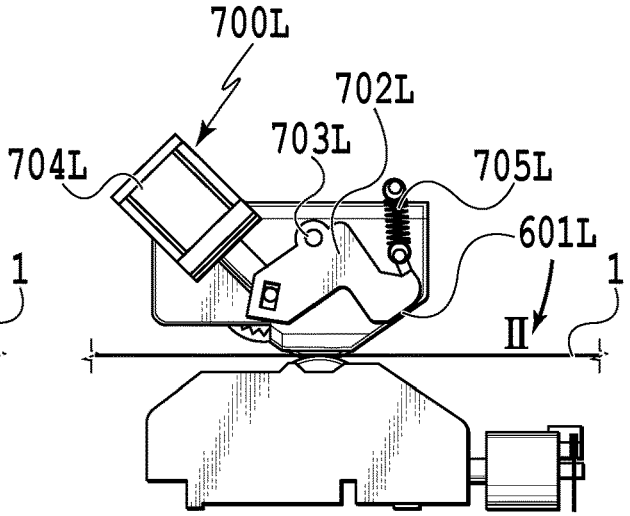
FIG.8C
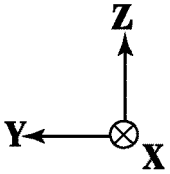

PRINTING APPARATUS AND CONVEYANCE APPARATUS

BACKGROUND OF THE INVENTION

Field of the Invention

The present invention relates to a printing apparatus and a conveyance apparatus that are capable of cutting a conveyed sheet-shaped printing medium.

Description of the Related Art

Japanese Patent Laid-Open No. 2017-13438 discloses a technology related to a conveyance apparatus including a slitter for cutting a printing medium along the conveying direction after printing is performed on the printing medium. Specifically, according to the technology disclosed in Japanese Patent Laid-Open No. 2017-13438, the leading edge of a conveyed printing medium is inserted to the slitter, so that the printing medium is cut along the conveyance direction in accordance with conveyance of the printing medium.

However, the leading edge of the printing medium may float due to cockling, which makes the printing medium wave because of ink application, or the like. Therefore, in the technology disclosed in Japanese Patent Laid-Open No. 2017-13438, there is a possibility that, due to such floating of the leading edge at the time of cutting a printing medium, the position of the leading edge to be cut by the slitter undesirably deviates in the direction orthogonal to the conveyance direction.

SUMMARY OF THE INVENTION

The present invention has been made in view of the above problem and provides a printing apparatus and a conveyance apparatus that are capable of preventing the cut position to be cut by the slitter from deviating.

In the first aspect of the present invention, there is provided a printing apparatus comprising:

a conveyance unit configured to convey a printing medium in a conveyance direction;

a printing unit configured to print an image on the printing medium conveyed by the conveyance unit; and a cutting unit configured to cut the printing medium on which the image is printed by the printing unit, the printing medium being cut at a cut position along the conveyance direction, wherein the printing medium is cut by the cutting unit while being conveyed by the conveyance unit, and wherein the printing apparatus includes an abutment portion configured to abut on a printing surface on which the printing unit prints the image of the printing medium at an inner position relative to the cut position in a width direction of the printing medium, the width direction that intersects the conveyance direction.

In the second aspect of the present invention, there is provided a conveyance apparatus comprising:

a conveyance unit configured to convey a printing medium on which an image is printed in a conveyance direction; and a cutting unit configured to cut the printing medium at a cut position along the conveyance direction, wherein the printing medium is cut by the cutting unit while being conveyed by the conveyance unit, and wherein the conveyance apparatus includes an abutment portion configured to abut on a printing surface of the printing medium at an inner position relative to the cut position in a width direction of the printing medium, the width direction that intersects the conveyance direction.

According to the present invention, it is possible to prevent the cut position to be cut by the slitter (cutting unit) from deviating.

Further features of the present invention will become apparent from the following description of exemplary embodiments with reference to the attached drawings.

BRIEF DESCRIPTION OF THE DRAWINGS

FIGS. 8A, 8B and 8C are diagrams illustrating a modification example of the slitter unit.

DESCRIPTION OF THE EMBODIMENTS

Hereinafter, an explanation is given of embodiments of the present invention with reference to the drawings. The following embodiments do not limit the present invention. Further, every combination of the characteristics explained in the present embodiments is not essential to the solution means of the present invention. The same reference sign is assigned for explanation of the identical configuration. In addition, relative positions, shapes, and the like, of the constituent elements described in the embodiments are merely examples and are not intended to limit the present invention to the range of the examples.

Figure 1:
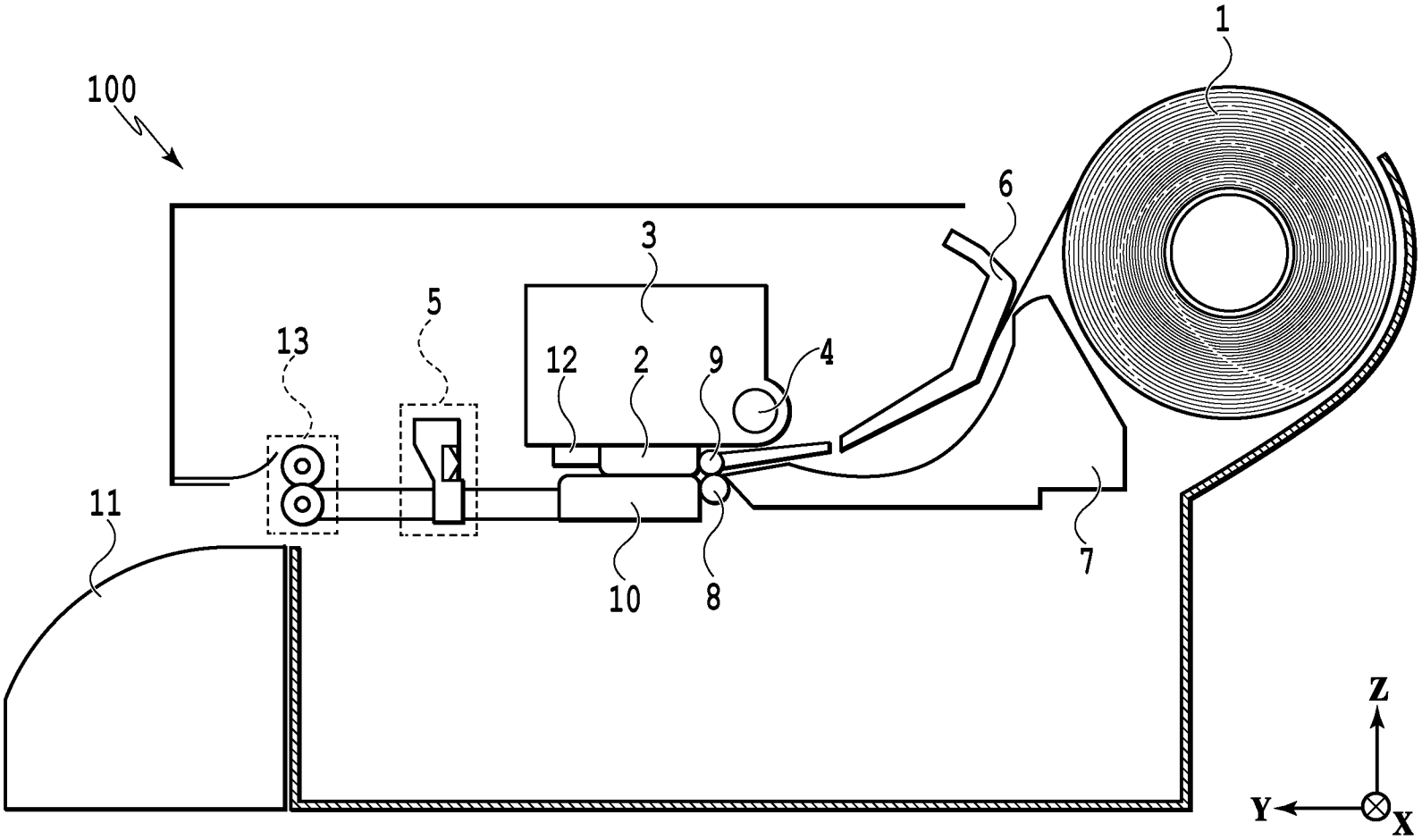
FIG. 1 is a cross-sectional view illustrating a schematic configuration of a printing apparatus.

FIG. 1 is a cross-sectional view illustrating an example of an inkjet printing apparatus according to the present embodiment. The inkjet printing apparatus 100 (hereinafter simply referred to as the printing apparatus 100) performs printing on a printing medium that has a shape of a long sheet. In the present embodiment, the printing medium is a roll sheet 1. The roll sheet 1 held in the printing apparatus 100 is conveyed to the downstream through a conveyance path formed by the upper guide 6 and the lower guide 7. The roll sheet 1 is nipped by the conveyance roller 8 and the pinch roller 9 and conveyed to an image printing unit. The image printing unit is configured to include the print head 2, the carriage 3 on which the print head 2 is mounted, and the platen 10 disposed at a position facing the print head 2. The roll sheet 1 is conveyed onto the platen 10 by the conveyance roller 8. Ink is ejected by the print head 2 onto the roll sheet 1 conveyed to the image printing unit, so as to print an image.

The carriage 3 is supported so as to be able to perform a sliding motion along the guide shaft 4 and a guide rail (not illustrated in the drawing) that are disposed in parallel to each other in the printing apparatus 100. The carriage 3 includes the reflection type detection sensor 12 facing the platen 10, so as to be able to detect the reflectivity of a spot position. That is, in a case where the platen 10 is black and the roll sheet 1 is white, the reflectivity of the platen 10 and the roll sheet 1 are greatly different. Therefore, it is possible to determine whether the platen 10 is present or the roll sheet 1 is present at the spot position by use of the detection sensor 12. It is possible to detect the leading edge of the roll sheet 1 by utilizing the fact that, while the roll sheet 1 is conveyed by the conveyance roller 8, the reflectivity greatly changes in a case where the leading edge of the roll sheet 1 in the conveyance direction passes through the spot position of the detection sensor 12.

The carriage 3 scans in the X direction along the guide shaft 4 while holding the print head 2, and the print head 2 ejects ink while the carriage 3 scans, so as to perform printing on the roll sheet 1. After a scan by the carriage 3 to perform printing on the roll sheet 1, the conveyance roller 8 conveys the roll sheet 1 by a predetermined amount, and the carriage 3 scans on the roll sheet 1 again to perform printing. In this way, by repeating printing and conveying, the entire printing is completed. Furthermore, since the detection sensor 12 is mounted on the carriage 3, the positions of the paper edges in the width direction (X direction) of the roll sheet 1 can also be detected by the reciprocating operation of the carriage 3.

On the downstream relative to the carriage 3 in the conveyance direction of the roll sheet 1, there is provided the cutter 5 for cutting the roll sheet 1 in a direction intersecting the conveyance direction, and, on the further downstream, there is provided the slitter 13 (cutting unit) for cutting the roll sheet 1 in the conveyance direction. On the downstream relative to the slitter 13, there is provided the discharging guide 11 for discharging the roll sheet 1 that has been cut.

The cutter 5 includes a cutter unit 300 (see FIG. 2) as a cutting mechanism for cutting the roll sheet 1 and a unit for moving the cutter unit 300 along the X direction. Furthermore, the slitter 13 includes a slitter unit 303 (see FIG. 2) as a cutting mechanism for cutting the roll sheet 1 and a unit for moving the slitter unit 303 along the X direction.

Figure 2:
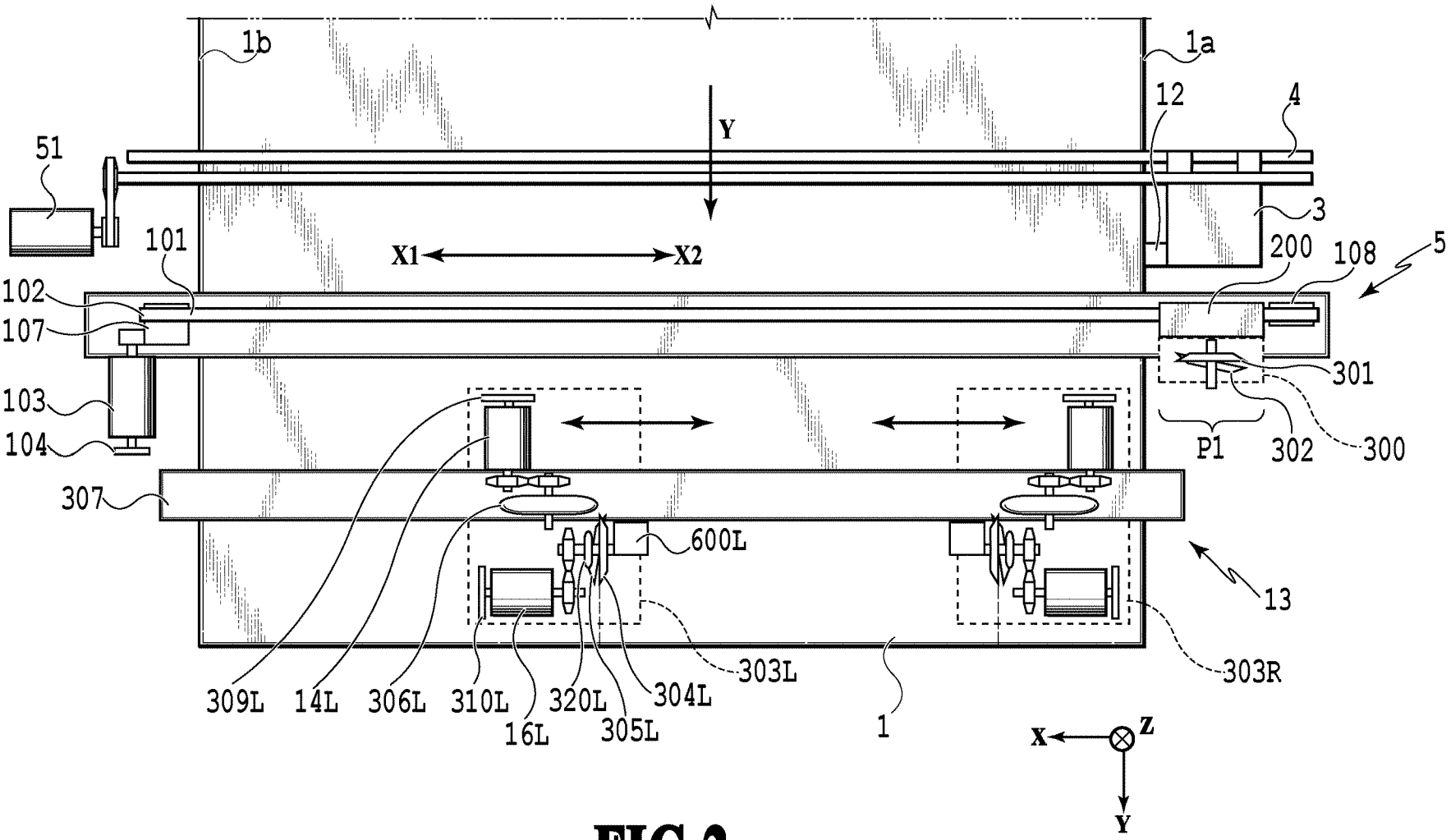
FIG. 2 is a diagram for explaining a cutter and a slitter.

FIG. 2 is a top view for explaining the cutter 5 and the slitter 13 including the slitter units 303L and 303R. In the present specification, "L" and "R" at the end of the reference signs indicate a member on the left side (that is, +X side) and a member on the right side (that is, −X side) on the drawings, respectively. In the present specification, such an end of a reference sign may be omitted in a case of members that are the same on the left side and the right side.

The guide rail 101 is configured to guide the cutter carriage 200 in the direction intersecting the conveyance direction of the roll sheet 1. The cutter carriage 200 integrally connects the cutter unit 300 and the belt 102. Furthermore, the belt 102 is configured to bridge the motor pulley 107 and the tensioner pulley 108 disposed on the left and right sides of the guide rail 101 and is configured to be moved by the cutter motor 103 connected to the motor pulley 107. The cutter motor 103 is provided with the cutter encoder 104. The cutter encoder 104 counts the number of pulses corresponding to driving of the cutter motor 103. Based on the origin position of the cutter carriage 200 and the number of pulses obtained by the cutter encoder 104, it is possible to control the movement position of the cutter unit 300 in the X1 and X2 directions.

The cutter unit 300 includes the upper movable blade 301 and the lower movable blade 302, so that the roll sheet 1 is cut at the contact point of the upper movable blade 301 and the lower movable blade 302 while the cutter unit 300 moves in the X1 direction. Furthermore, the upper movable blade 301 and the lower movable blade 302 are connected to the cutter motor 103 via the belt 102 and the cutter carriage 200 and are configured to be rotationally driven. In a case where the roll sheet 1 is cut, the roll sheet 1 is cut while the lower movable blade 302 and the upper movable blade 301, which is in contact with the lower movable blade 302, rotate together. In the example of FIG. 2, the cutter unit 300 performs cutting from the first end 1*a* of the roll sheet 1 to the second end 1*b* of the roll sheet 1. The first end 1*a* of the roll sheet 1 is an end on the stand-by position P1 side of the cutter unit 300. After the roll sheet 1 is cut, the cutter carriage 200 is reversed at a predetermined reversing position. Further, the cutter carriage 200 moves to a position that is the stand-by position P1 to stand by for the next cutting operation. Although the cutter unit 300 is mounted on the cutter carriage 200 in the example of the present embodiment, the cutter unit 300 may be mounted on the carriage 3 that moves the print head 2, etc., for example.

The slitter 13 is disposed on the downstream side relative to the cutter 5 in the conveyance direction of the roll sheet 1. The slitter 13 is able to move a slitter unit 303 to a given position in the X1 and X2 directions and is able to cut the roll sheet 1 in the direction parallel to the conveyance direction (+Y direction) by use of the slitter unit 303. In the present embodiment, an explanation is given of a configuration in which two slitter units 303 are mounted. That is, an explanation is given of the example in which the slitter units 303L and 303R are mounted. The slitter units 303L and 303R have the same configuration with the components that are left-right reversals in the X1 and X2 directions. In FIG. 2, for the sake of simplification, reference signs are mainly assigned to the components of the slitter unit 303L.

Figure 3A:
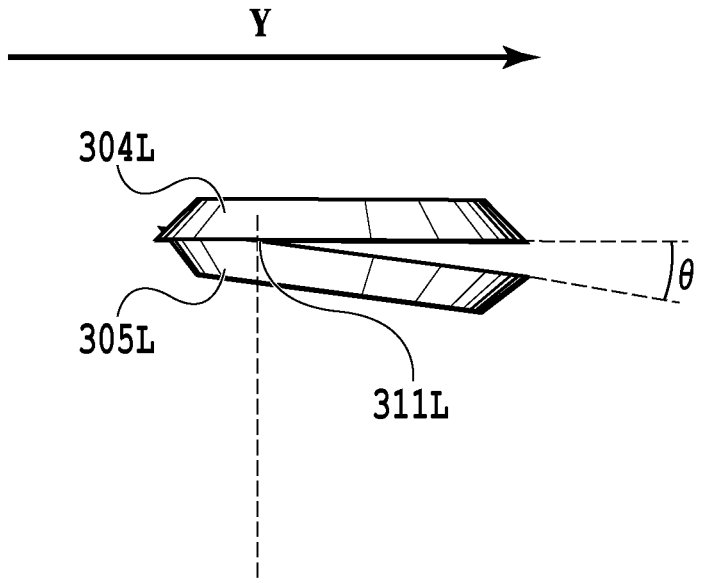
FIGS. 3A and 3B are diagrams illustrating a relationship between an upper movable blade and a lower movable blade in a slitter unit.
Figure 3B:
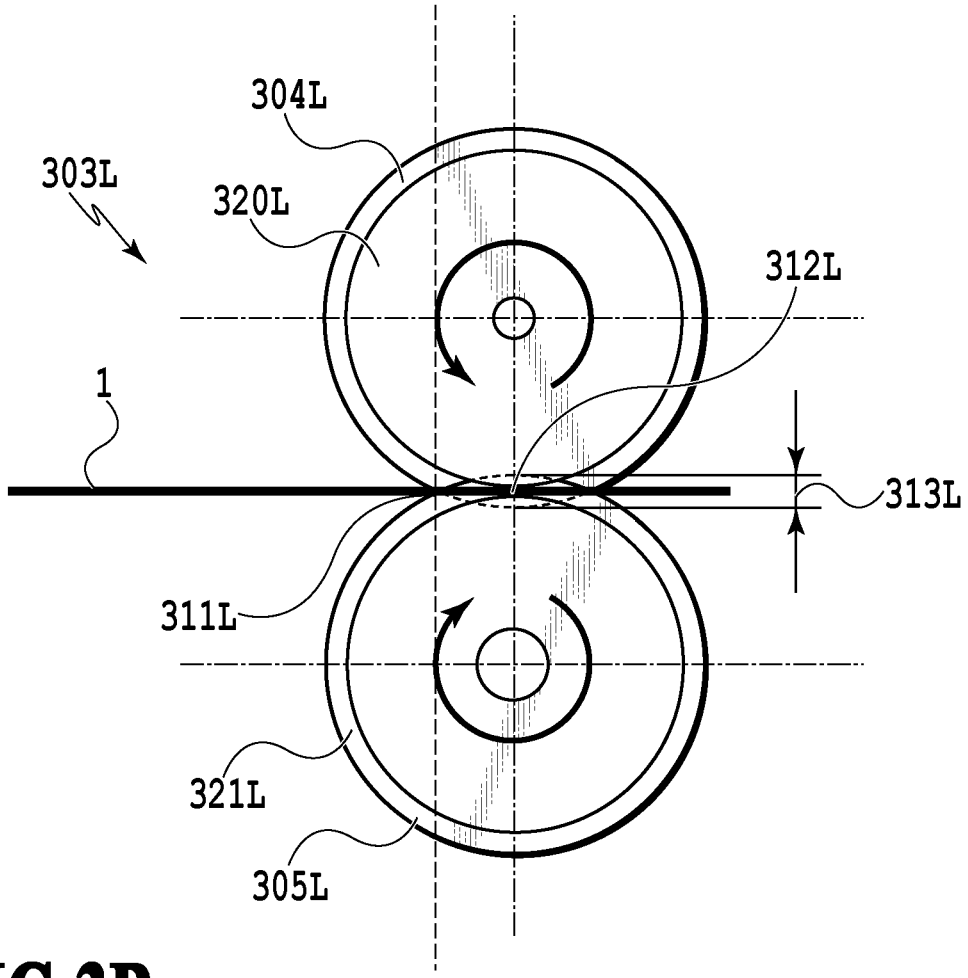
Figure 4A:
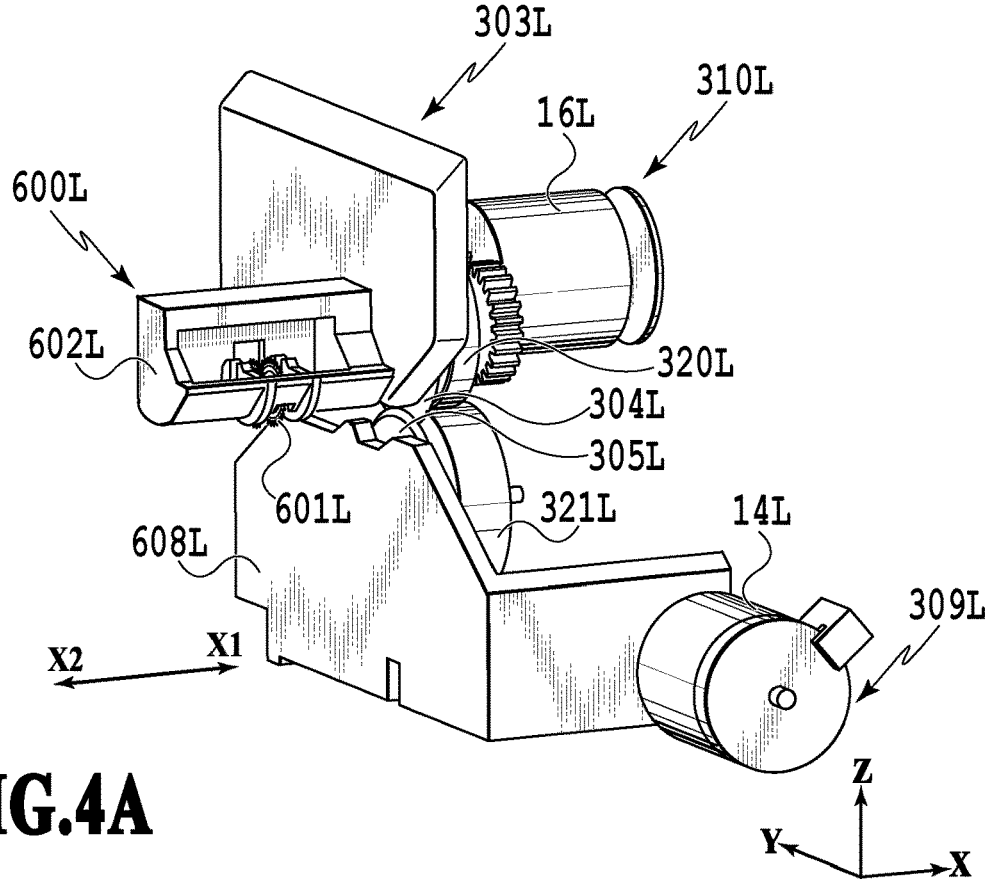
FIGS. 4A and 4B are diagrams for explaining a configuration of the slitter unit.
Figure 4B:
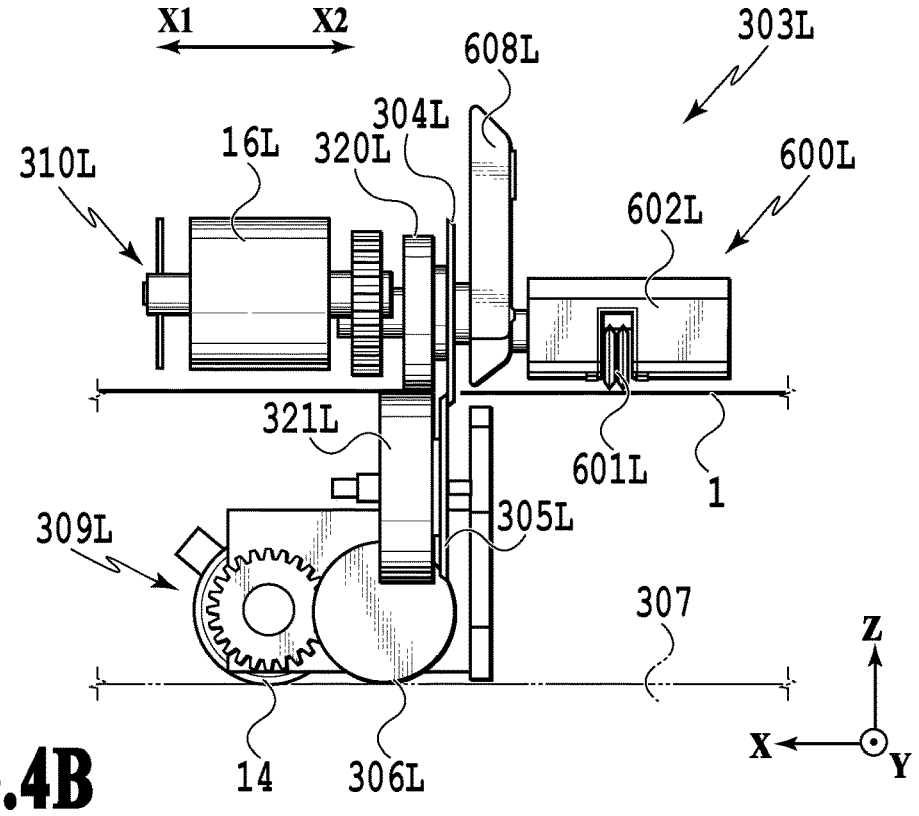
Figure 5:
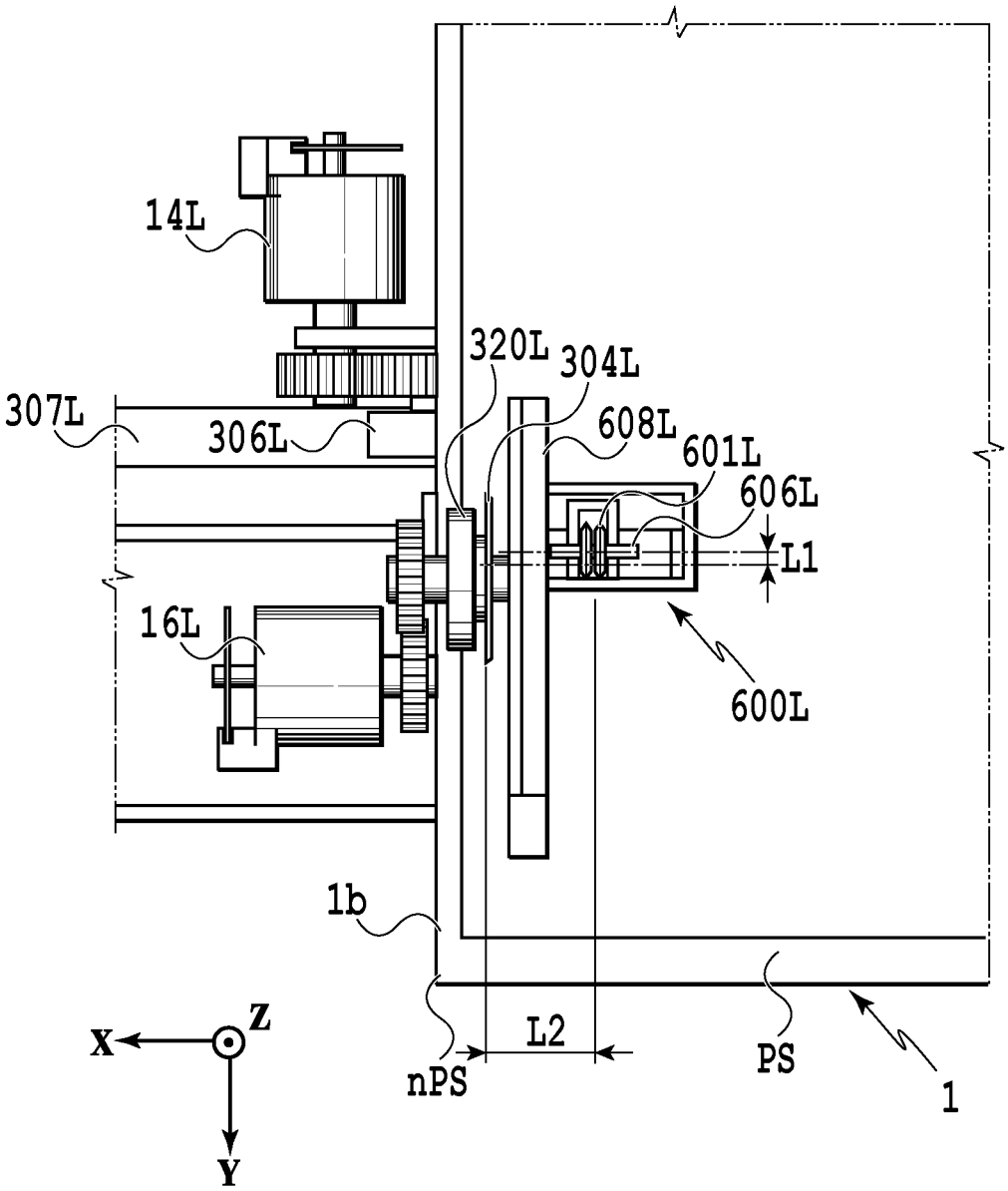
FIG. 5 is a diagram for explaining a regulating position of a regulating portion.

FIGS. 3A through FIG. 5 are diagrams for explaining details of the slitter unit 303L. FIG. 3A is a schematic plan view of the slitter upper movable blade 304L and the slitter lower movable blade 305L of the slitter unit 303L. FIG. 3B is a schematic side view of the slitter upper movable blade 304L, the slitter lower movable blade 305L, the slitter upper conveyance roller 320L, and the slitter lower conveyance roller 321L of the slitter unit 303L. FIG. 4A is a back side perspective view of the slitter unit 303L, and FIG. 4B is a front view of the slitter unit 303L. FIG. 5 is a diagram for explaining a regulating position of the regulating portion 600L.

The slitter unit 303L includes the slitter upper movable blade 304L and the slitter lower movable blade 305L. The slitter upper movable blade 304L and the slitter lower movable blade 305L are disposed so as to have a round blades overlap amount 313L in the vertical direction and have a predetermined amount of angle (intersect angle) θ relative to the conveyance direction Y, which is the cutting direction. The roll sheet 1 is cut at the contact point 311L of the slitter upper movable blade 304L and the slitter lower movable blade 305L. That is, in a slitter unit 303 of the present embodiment, the slitter upper movable blade 304 and the slitter lower movable blade 305 function as a cutting portion that cuts a printing medium. The slitter upper movable blade 304L is connected to the slitter driving motor 16L via a gear.

In a case where the slitter upper movable blade 304L is rotated by driving of the slitter driving motor 16L, the slitter upper conveyance roller 320L, which is connected coaxially with the slitter upper movable blade 304L, rotates as well. The outer peripheral surface of the slitter upper conveyance roller 320L is in contact with the outer peripheral surface of the slitter lower conveyance roller 321L, which is connected coaxially with the slitter lower movable blade 305L, at the roller nip point 312L. Thus, by driving with friction transmission, while the roll sheet 1 is conveyed by the slitter upper conveyance roller 320L and the slitter lower conveyance roller 321L, the upper and lower blades rotate together to cut the roll sheet 1 in the conveyance direction. That is, in a slitter unit 303 of the present embodiment, the slitter upper conveyance roller 320 and the slitter lower conveyance roller 321 function as a conveying portion that conveys a printing medium.

Each of the slitter upper conveyance roller 320L and the slitter lower conveyance roller 321L is positioned on the outer side of the roll sheet 1 in the X direction, compared to the contact point 311L of the slitter upper movable blade 304L and the slitter lower movable blade 305L (see FIG. 5). The outer side of the roll sheet 1 is directed to the second end 1*b* of the roll sheet 1, that is, to the region where the image to be recorded as a product is not printed (the nPS side in FIG. 5).

Since the slitter driving motor 16L is provided with the slitter driving encoder 310L, it is possible to control the slitter driving motor 16L with a predetermined rotation speed and a predetermined rotation amount. The slitter driving motor 16L is controlled to drive at a driving amount (specifically, a rotation speed and a rotation amount), which is synchronized with and corresponding to the conveyance amount by the conveyance roller 8.

The slitter unit 303L includes the slitter moving motor 14L and is configured such that driving force is transmitted to the slitter moving roller 306L via a gear. The slitter moving roller 306L abuts on the slitter guide rail 307, which extends in the X direction. Furthermore, the slitter unit 303L is configured to be movable in the X1 and X2 directions by friction between the outer peripheral surface of the slitter moving roller 306L and the slitter guide rail 307. The slitter moving motor 14L is provided with the slitter moving encoder 309L, so that it is possible to control the movement position of the slitter unit 303L from the stand-by position P1.

In the slitter unit 303L, each of the components including the later-described regulating portion 600L is held by the holding member 608. Accordingly, the slitter upper movable blade 304L, the slitter lower movable blade 305L, the slitter upper conveyance roller 320L, the slitter lower conveyance roller 321L, and the regulating portion 600L are integrally movable along the slitter guide rail 307. Although the slitter moving roller 306L is driven with friction in the present embodiment, the slitter moving roller 306L may have a rack and pinion configuration with a slitter moving roller serving as a pinion and a slitter guide rail serving as a rack. That is, in the present embodiment, the slitter moving motor 14L, the slitter moving roller 306L, the slitter guide rail 307, etc., function as a moving portion for moving the slitter unit 303L in the X direction.

For ensuring the flatness of the roll sheet 1 at the time of cutting the roll sheet 1 after printing, the regulating portion 600L that regulates floating of the roll sheet 1 is disposed in the slitter unit 303L as illustrated in FIGS. 4A and 4B. The regulating portion 600L is positioned on the inner side of the roll sheet 1 in the X direction, compared to the contact point 311L. The inner side of the roll sheet 1 is directed to the first end 1*a* of the roll sheet 1, that is, to the region where the image to be recorded as a product is printed (the PS side in FIG. 5).

The regulating portion 600L includes the spur 601L, which abuts on the printing surface side of the roll sheet 1 to regulate floating of the roll sheet 1, and the holding portion 602L, which does not abut on the roll sheet 1 and holds the spur 601L. In the regulating portion 600L, the spur 601L serves as a member that abuts on the printing surface to regulate floating of the roll sheet 1, so that transfer of an image printed on the printing surface is prevented. Furthermore, the spur 601L is held by the holding portion 602L via the elastic member 606L (see FIG. 5) such as a spring, so that the spur 601L is configured to elastically act on the roll sheet 1. That is, in the present embodiment, the regulating portion 600 functions as an abutment portion that abuts on a printing medium.

The regulating position where the spur 601L abuts on the roll sheet 1 to regulate floating of the roll sheet 1 matches up with the contact point 311L (see FIG. 3B) in the Z direction, which is orthogonal to the conveyance direction and the width direction. Accordingly, it is possible to regulate floating of the roll sheet 1 such that the position of the roll sheet 1 approximately matches up with the contact point 311L in the Z direction. The meaning of matching up of the regulating position and the contact point 311L in the Z direction is not limited to a complete match, and there may be a predetermined range. Furthermore, as illustrated in FIG. 5, the regulating position is positioned on the upstream side relative to the contact point 311L in the conveyance direction (−Y direction side) by the length L1. Moreover, as illustrated in FIG. 5, the regulating position is positioned on the inner side of the roll sheet 1 relative to the contact point 311L in the X direction by the length L2 (for example, 10 mm). As for the lengths L1 and L2, values with which the flatness of the roll sheet 1 in the vicinity of the contact point 311L is ensured in a case where the leading edge of the conveyed roll sheet 1 reaches the contact point 311L are obtained by an experiment and set, for example. In a case where the above-mentioned predetermined range is provided, the predetermined range may be obtained by an experiment.

Figure 6:
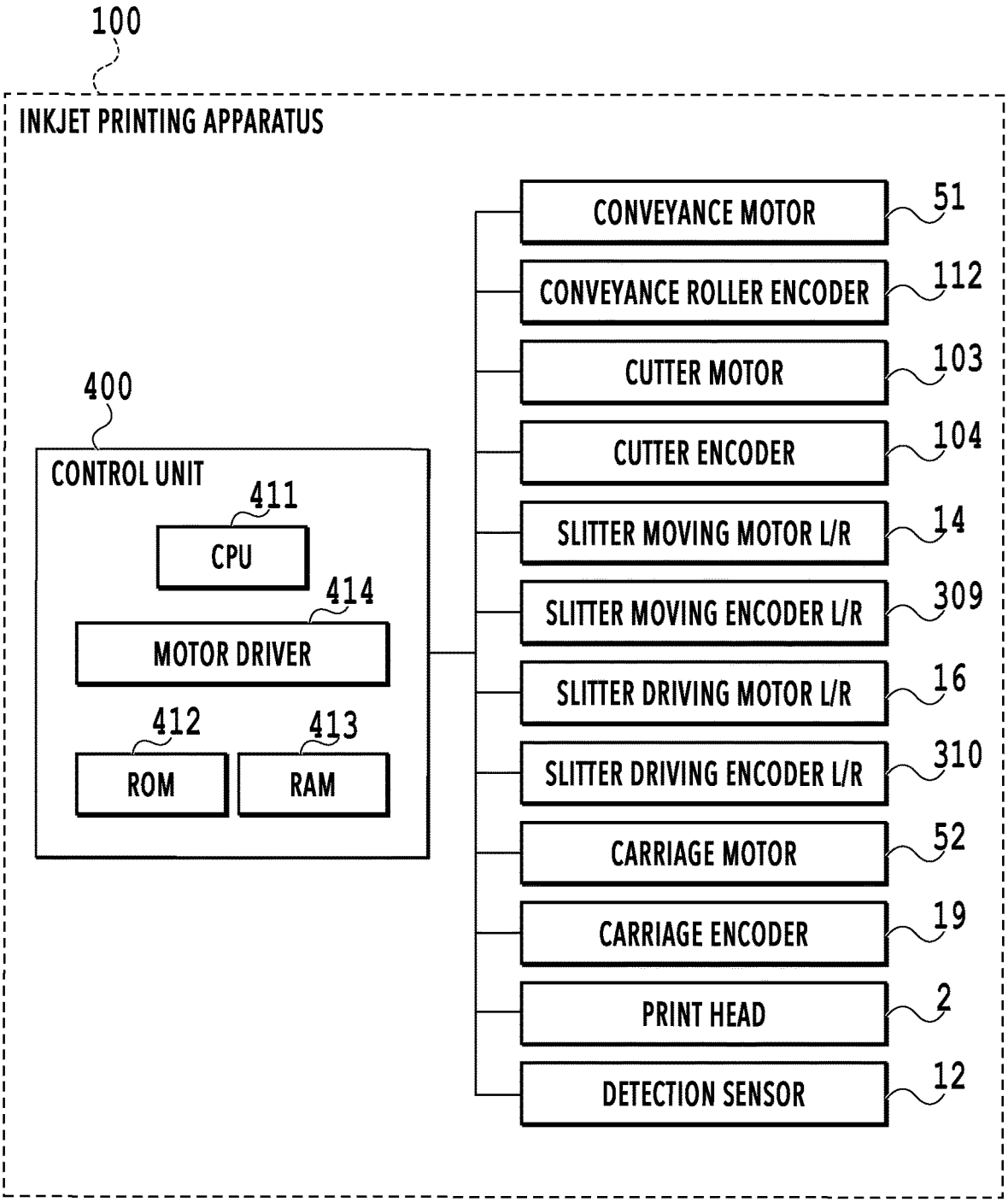
FIG. 6 is a block configuration diagram of a control system of the printing apparatus.

FIG. 6 is a schematic block diagram illustrating a control configuration of the printing apparatus 100. The printing apparatus 100 includes a control unit 400. Furthermore, the control unit 400 includes a CPU 411, a ROM 412, a RAM 413, and a motor driver 414. The control unit 400 implements control of a conveyance motor 51, a cutter motor 103, a slitter moving motor 14, a slitter driving motor 16, a carriage motor 52, and a print head 2. The control unit 400 obtains signals from a conveyance roller encoder 112, a cutter encoder 104, a slitter moving encoder 309, a slitter driving encoder 310, a carriage encoder 19, and a detection sensor 12. Moreover, the control unit 400 controls the various motors and the print head 2, based on the signals.

As described above, the printing apparatus 100 is configured such that the slitter 13 is capable of cutting a predetermined region of the width (X direction) of the roll sheet 1 after printing. Therefore, in the printing apparatus 100, for example, by cutting the region adjacent in the width direction to the image to be recorded as a product by use of the slitter 13, it is possible to obtain such a printed subject as obtained in a case where left-right borderless printing is performed by a printing apparatus that is not provided with the slitter 13. In this case, since it is not necessary to apply ink such that the ink is ejected outside the roll sheet 1, it is possible to greatly prevent the ink from adhering to the platen 10. Hereinafter, an explanation is given of a case in which borderless printing in the left and right direction, or the X direction, is performed by the printing apparatus 100 on the roll sheet 1.

In a case where an instruction for starting left-right borderless printing on the roll sheet 1 is provided by the user, first, the slitter moving motors 14L and 14R are driven, so as to move the slitter units 303L and 303R to cutting positions, respectively. The cutting positions of the slitter upper movable blades 304 and the slitter lower movable blades 305 are, for example, the positions of the end portions in the X direction of the region PS in which the image to be recorded as a product is printed.

Next, the conveyance motor 51 and the slitter driving motors 16 are driven such that the conveyance speed of the conveyance roller 8 and the conveyance speed of the slitter upper conveyance rollers 320 are the same speed, so that the roll sheet 1 is conveyed by the conveyance roller 8. Thereafter, in a case where it is detected that the leading edge of the roll sheet 1 has been conveyed up to the printing start position, based on a detection result of a sensor (not illustrated in the drawings), printing on the roll sheet 1 is performed based on print data.

In a case where printing proceeds and the leading edge of the roll sheet 1 reaches the contact points 311 of the slitter units 303, the roll sheet 1 is cut by the slitter upper movable blades 304 and the slitter lower movable blades 305 that are rotating on the left and right.

Figure 7A:
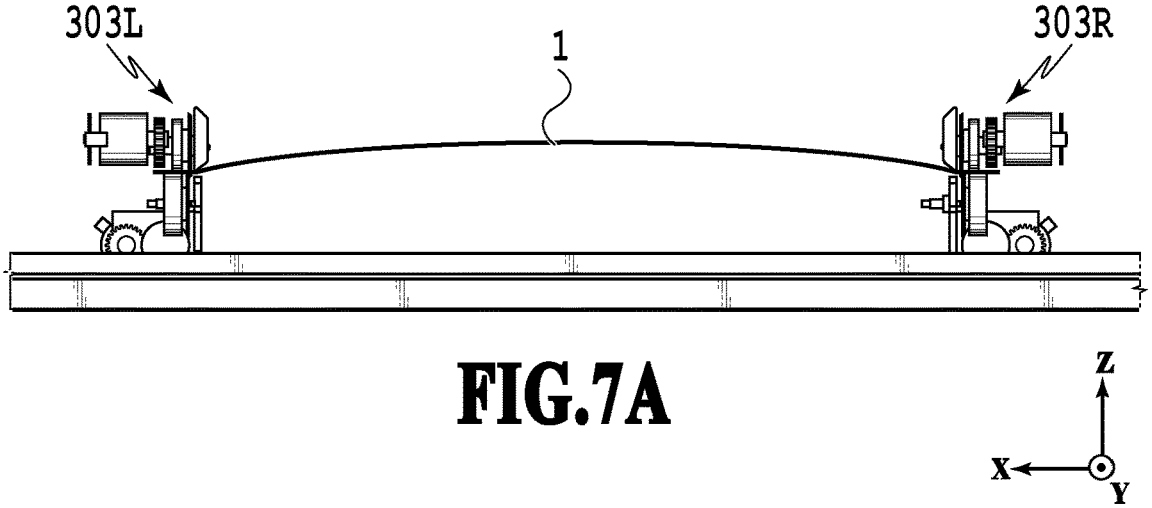
FIGS. 7A, 7B and 7C are diagrams for explaining the flatness in the vicinity of the positions that are cut by upper movable blades and lower movable blades.
Figure 7B:
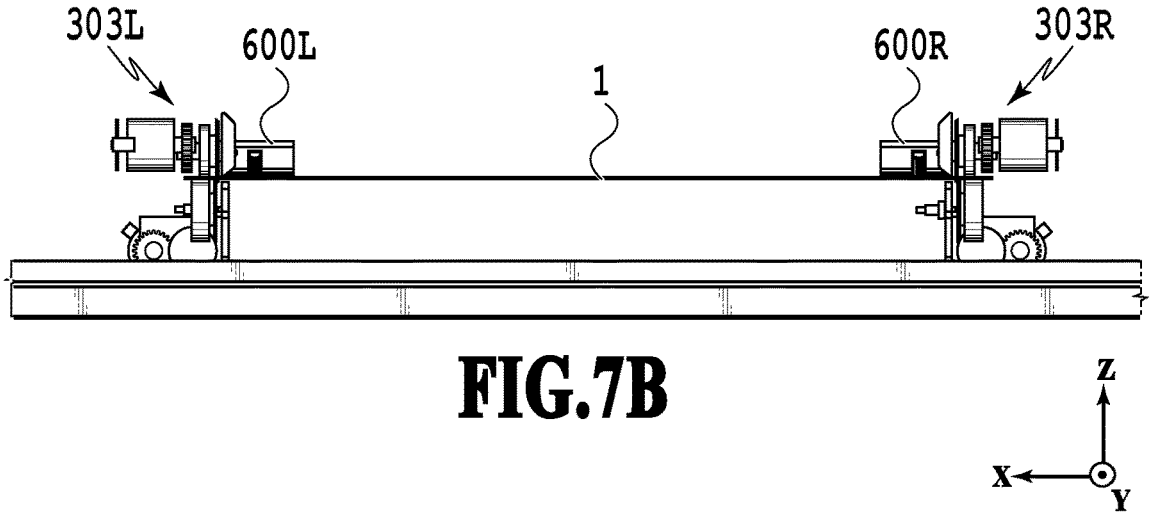
Figure 7C:
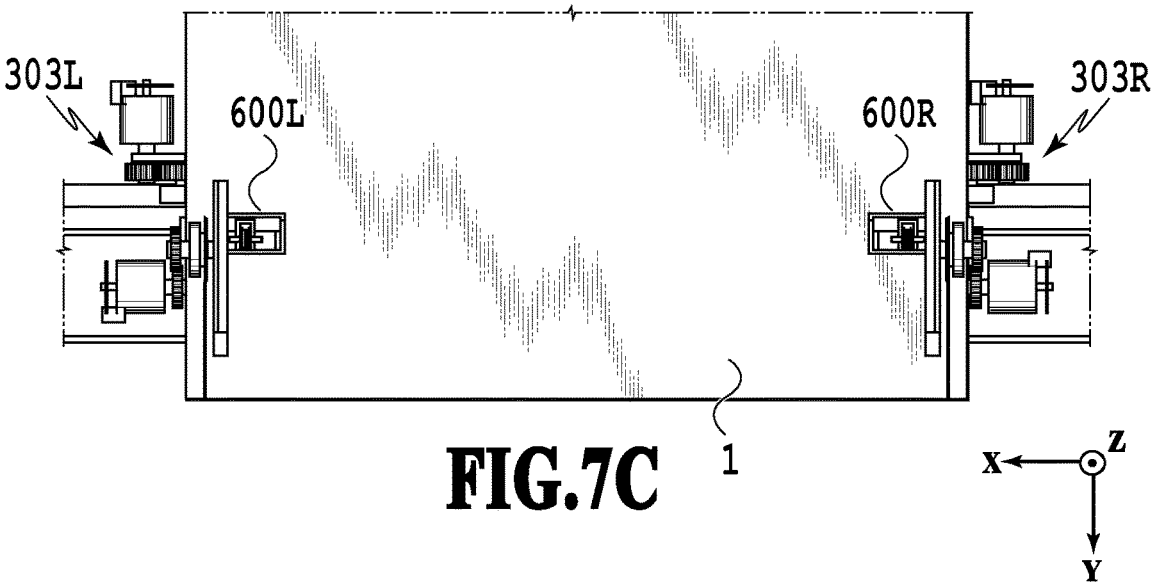

Here, FIG. 7A is a front view illustrating the roll sheet 1 in a case where the regulating portions 600 are not disposed in the slitter units 303. FIG. 7B is a front view illustrating the roll sheet 1 in a case where the regulating portions 600 are disposed in the slitter units 303. FIG. 7C is a plan view for explaining the cutting of the roll sheet 1 by the slitter units 303 in which the regulating portions 600 are disposed.

As illustrated in FIG. 7A, if the roll sheet 1 is conveyed by simply holding two locations of the roll sheet 1 in the X direction, the middle part of the roll sheet 1 between the two held locations floats in a case where cockling of the roll sheet 1 occurs due to application of ink. If the leading edge of the roll sheet 1 reaches the contact point 311L in that state, cutting deviation occurs in the vicinity of the leading edge.

In the present embodiment, as illustrated in FIG. 7B, the regulating portions 600 for regulating floating of the roll sheet 1 are disposed in the slitter units 303. According to such a configuration, the flatness of the roll sheet 1 in the vicinity of the contact points 311 is ensured at the time where the leading edge of the roll sheet 1 reaches the contact points 311. Therefore, in a case where the regulating portions 600 are disposed, the posture of the leading edge of the roll sheet 1 is stabilized at the time where the leading edge of the roll sheet 1 reaches the contact points 311, compared to the case where the regulating portions 600 are not disposed.

Thereafter, the roll sheet 1 is cut by the slitter upper movable blades 304 and the slitter lower movable blades 305, and the cut pieces of the roll sheet 1 on the sides that have been cut are nipped and conveyed by the slitter upper conveyance rollers 320 and the slitter lower conveyance rollers 321. As described above, at the contact points 311, the posture of the roll sheet 1 is stabilized by the regulating portions 600. Therefore, as for the roll sheet 1 that has been cut by the slitter units 303, since cutting deviation is prevented from occurring, the cutting accuracy is stabilized at the leading edge (see FIG. 7C).

Upon completion of the printing, cutting by the slitter units 303 is performed up to predetermined positions. Thereafter, the slitter units 303L and 303R are moved to the respective stand-by positions, and the roll sheet 1 is conveyed up to a position where the cutter unit 300 can cut the roll sheet 1. Then, the roll sheet 1 is cut by the cutter unit 300. Accordingly, the printed subject of the roll sheet 1, on which the image to be recorded as a product has been printed, and the cut pieces, on which the printing is not performed, are discharged through the discharging guide 11.

As explained above, in the printing apparatus 100, the regulating portions 600 abut on the roll sheet 1 at positions that are inner in the X direction relative to the contact points 311 and on the upstream side of the conveyance direction in the Y direction relative to the contact points 311 and that match up with the contact points 311 in the Z direction, so that floating of the roll sheet 1 is regulated. Accordingly, even though floating of the roll sheet 1 occurs due to cockling, it is possible to ensure the flatness of the roll sheet 1 at the time where the roll sheet 1 reaches the contact points 311. Therefore, it is less likely that the cut positions to be cut by the slitter 13 at the leading edge of the roll sheet 1 deviate in the width direction. (Other embodiments)

The above-described embodiment may be modified as shown in the following (1) through (5).

(1) Although not particularly described in the above-described embodiment, floating of the roll sheet 1 may be regulated by a regulating portion 700 that is configured to be capable of selectively switching a regulating posture, in which a spur 601 abuts on the roll sheet 1 so as to regulate floating of the roll sheet 1, and a retracted posture, in which the spur 601 does not abut on the roll sheet 1. Hereinafter, a detail explanation is given of regulating portions 700 with reference to FIGS. 8A, 8B and 8C. As described above, since the slitter units 303L and 303R are configured to be left-right reversals with each other, an explanation is given of the regulating portion 700L provided in the slitter unit 303L in the following description, and an explanation about the slitter unit 303R is omitted.

FIG. 8A is a schematic configuration diagram of the slitter unit 303L including the regulating portion 700L. FIG. 8B is a side view of the slitter unit 303L in which the regulating portion 700L is in the regulating posture. FIG. 8C is a side view of the slitter unit 303L in which the regulating portion 700L is in the retracted posture. In the following explanations, the same or corresponding configurations as those of the slitter unit 303L of the above-described embodiment are assigned with the same reference signs, so as to omit detailed explanations thereof as appropriate.

In the regulating portion 700L, the holding portion 702L for holding the spur 601L is fixed to the shaft 703L so as to be revolvable relative to the holding member 608L in the directions of the arrows I and II. The spring 705L is provided for pivotally moving the holding portion 702L in the direction of the arrow I in a case where the regulating portion 700L is in the regulating posture (first posture), so that the posture is switched to the retracted posture. Furthermore, the pivotal movement control portion 704L is provided for pivotally moving the holding portion 702L in the direction of the arrow II in a case where the regulating portion 700L is in the retracted posture (second posture), so that the posture is switched to the regulating posture. For example, the pivotal movement control portion 704L is configured as a solenoid, so that, by electrification, the holding portion 702L is pivotally moved in the direction of the arrow II against the biasing force of the spring 705L.

With such a configuration, in a case of performing left-right borderless printing, the regulating portion 700L is switched to the retracted posture or the regulating posture, based on information about the type of printing medium, which is input by the user, for example. More specifically, for example, in a case of using a printing medium having so high rigidity that cockling, or the like, hardly occurs, electrification to the pivotal movement control portion 704L is cancelled, so that the regulating portion 700L is switched to the retracted posture by the biasing force of the spring 705L. Such a printing medium having so high rigidity that cockling, or the like, hardly occurs is glossy paper, an art sheet, or the like. Furthermore, in a case of using a printing medium having so low rigidity that cockling, or the like, easily occurs, the pivotal movement control portion 704L is electrified, so that the regulating portion 700L is switched to the regulating posture against the biasing force of the spring 705L.

In this manner, regarding regulation of floating of a printing medium by use of the regulating portion 700L, the spur 601L does not abut on the image, which is a product, in a case of a printing medium to which the regulation is not necessary, and, thus, transfer of the image is surely prevented.

(2) In the above-described embodiment, the explanation has been given with the example of what is termed as a serial scan type printing apparatus, in which a print head is moved in the X direction and a printing medium is moved in the Y direction. However, what is termed as a full-line type printing apparatus, in which ink is ejected across the width direction of a printing medium, may be used. Furthermore, although not particularly described in the above embodiment, for the configurations of the slitter units 303 for cutting a printing medium and moving in the X direction, various publicly known technologies may be used.

(3) In the above-described embodiment, the slitter 13 includes two slitter units 303. However, only one slitter unit 303 or more than three slitter units 303 may be included. Furthermore, in the above-described embodiment, printing is performed by the printing apparatus 100 in an ink jet system. However, the printing strategy of the printing apparatus 100 may be any of various publicly known printing strategies.

(4) Although not particularly described in the above embodiment, the regulating portions 600 may be configured such that the positions of the regulating portions 600 can be adjusted in the X, Y, and Z directions relative to the holding members 608, so that the regulating positions are adjusted according to the type of printing medium, the ink application amount, or the like. In this case, the user may adjust the regulating positions of the regulating portions 600 by hand or via an operation panel provided on the printing apparatus 100. Moreover, it is possible to adjust the regulating positions of the regulating portions 600 by use of the control unit 400. In addition, although the slitter units 303 of the slitter 13 moves in the width direction of the roll sheet 1 by controlling of the control unit 400 in the above-described embodiment, the above-described embodiment is not limited thereto. That is, the slitter units 303 may be fixedly disposed, or may be configured to be movable by the user.

(5) The above-described embodiment and various forms shown in (1) through (4) may be combined as appropriate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-065975, filed Mar. 29, 2019, which is hereby incorporated by reference wherein in its entirety.

What is claimed is:

1. A printing apparatus comprising:

a conveyance unit configured to convey a printing medium in a conveyance direction;

a printing unit configured to print an image on the printing medium conveyed by the conveyance unit; and a cutting unit configured to cut the printing medium on which the image is printed by the printing unit, the printing medium being cut at a cut position along the conveyance direction, wherein the printing medium is cut by the cutting unit while being conveyed by the conveyance unit, and wherein the printing apparatus includes an abutment portion configured to abut on a printing surface on which the printing unit prints the image of the printing medium at an inner position relative to the cut position in a width direction of the printing medium, the width direction that intersects the conveyance direction.

2. The printing apparatus according to claim 1, wherein the abutment portion is configured to abut on the printing medium from the printing surface, the image being printed on the printing surface.

3. The printing apparatus according to claim 1, wherein the abutment portion is configured to abut on a side in a region on which the image is printed in the width direction.

4. The printing apparatus according to claim 1, wherein the abutment portion is configured to abut on the printing medium so as to regulate floating of the printing medium.

5. The printing apparatus according to claim 1, wherein the abutment portion is configured to abut on such a position that ensures flatness of the cut position of the printing medium.

6. The printing apparatus according to claim 1, wherein a position where the abutment portion abuts on the printing medium is on an upstream side relative to the cut position in the conveyance direction and matches up with the cut position in a direction orthogonal to the conveyance direction and the width direction.

7. The printing apparatus according to claim 1, wherein the abutment portion is configured to elastically act on the printing medium.

8. The printing apparatus according to claim 1, wherein the abutment portion is configured to abut on the printing medium via a spur.

9. The printing apparatus according to claim 1, wherein the abutment portion is configured to be switchable between a first posture in which the abutment portion abuts on the printing medium and a second posture in which the abutment portion does not abut on the printing medium.

10. The printing apparatus according to claim 1, wherein the cutting unit includes a conveying portion positioned outside the cut position in the width direction and configured to convey the printing medium in synchronization with the conveyance unit.

11. The printing apparatus according to claim 1, wherein the cutting unit includes at least one slitter unit that is provided with the abutment portion.

12. The printing apparatus according to claim 11, wherein the slitter unit includes a moving portion configured to move in the width direction.

13. The printing apparatus according to claim 1, wherein the cutting unit is configured to cut the printing medium by making two round blades make contact with each other, and wherein the cut position corresponds to a contact point where the two round blades make contact with each other.

14. The printing apparatus according to claim 1, further comprising a cutter configured to cut the printing medium in the width direction.

15. The printing apparatus according to claim 1, wherein the printing unit is configured to perform printing in an ink jet system.

16. A conveyance apparatus comprising:

a conveyance unit configured to convey a printing medium on which an image is printed in a conveyance direction; and a cutting unit configured to cut the printing medium at a cut position along the conveyance direction, wherein the printing medium is cut by the cutting unit while being conveyed by the conveyance unit, and wherein the conveyance apparatus includes an abutment portion configured to abut on a printing surface of the printing medium at an inner position relative to the cut position in a width direction of the printing medium, the width direction that intersects the conveyance direction.

* * * * *